US006478512B2

(12) United States Patent
Sherwood

(10) Patent No.: US 6,478,512 B2
(45) Date of Patent: Nov. 12, 2002

(54) MACHINE FOR MAKING BORED PILES

(75) Inventor: David Sherwood, Nanterre (FR)

(73) Assignee: Compagnie du Sol, Nanterre (FR)

( * ) Notice: Subject to any disclaimer, the term of this patent is extended or adjusted under 35 U.S.C. 154(b) by 0 days.

(21) Appl. No.: 09/829,785

(22) Filed: Apr. 10, 2001

(65) Prior Publication Data

US 2001/0032741 A1 Oct. 25, 2001

(30) Foreign Application Priority Data

Apr. 11, 2000 (FR) ..... 00 04612

(51) Int. Cl.[7] ..... E02D 7/00

(52) U.S. Cl. ..... 405/232; 405/233; 405/240; 405/256; 175/323

(58) Field of Search ..... 405/50, 232, 233, 405/236, 240, 241, 239, 242, 248, 256; 175/20, 171, 323, 394; 52/155, 157, 158, 169.13, 705, 707

(56) References Cited

U.S. PATENT DOCUMENTS

| | | | | |
|---|---|---|---|---|
| 3,300,988 | A | 1/1967 | Phrares et al. | 405/239 |
| 3,303,656 | A | 2/1967 | Landau | 405/241 X |
| 3,470,701 | A | 10/1969 | Turzillo | 405/233 |
| 3,485,052 | A | 12/1969 | Turzillo | 405/241 |
| 3,604,214 | A | 9/1971 | Turzillo | 175/323 X |
| 3,690,109 | A | 9/1972 | Turzillo | 405/241 |
| 3,707,848 | A | 1/1973 | Chelminski | 405/240 X |
| 3,886,754 | A | 6/1975 | Turzillo | 405/239 |
| 4,269,544 | A | 5/1981 | Rusche | 405/239 |
| 4,433,943 | A | 2/1984 | Pao Chen | 405/241 |
| 5,256,003 | A | 10/1993 | Ito et al. | 405/232 |
| 5,919,005 | A | 7/1999 | Rupiper | 405/236 X |
| 6,238,142 | B1 | 5/2001 | Harsch | 405/241 |

FOREIGN PATENT DOCUMENTS

| | | | |
|---|---|---|---|
| DE | 37 38 420 A1 | 11/1987 | |
| FR | 2 566 813 | 1/1986 | |
| FR | 2566813 | 1/1986 | 405/241 |
| GB | 2070668 | 9/1981 | 175/323 |

*Primary Examiner*—Heather Shackelford
*Assistant Examiner*—Jong-Suk Lee
(74) *Attorney, Agent, or Firm*—Merchant & Gould P.C.

(57) ABSTRACT

A machine for making bored piles. The machine includes a vertical guide mast; a rotary drive head that is movable relative to the mast; and an auger having a hollow core and at least one helical blade. An extender tube has a bottom end that is secured to the top end of the auger, the drive head co-operating with the extender tube to rotate both the extender tube and the auger. A dip tube is slidably mounted in the hollow core of the auger and the extender tube, the dip tube having a top end connected to a concrete feed pipe. An annular actuator has a first end secured to the top end of the extender tube and a second end secured to the top end of the dip tube.

6 Claims, 2 Drawing Sheets

MACHINE FOR MAKING BORED PILES

The present invention relates to an auger type machine for making bored piles.

More precisely, the invention relates to a machine capable both of boring a cylindrical excavation in the ground and of filling said excavation with grout or concrete so as to end up by defining a cast pile in the excavated ground.

BACKGROUND OF THE INVENTION

Accompanying FIG. 1 shows an auger type boring machine for making cast piles. The machine comprises a platform 10 which is preferably mounted on crawler tracks 12 and which has a guide mast 14 hinged thereto, which mast is vertical when in the working position. The mast 14 carries vertical slideways 16 on one of its faces to guide a carriage 18 in translation. The carriage 18 carries a rotary drive head 20 which co-operates with a hollow auger 22 constituted by a hollow core 24 and at least one helical blade 26. The rotary drive head 20 serves to rotate the auger 22, thereby causing it to dig into the ground by screw action, and thus making the borehole. Since the auger 22 is hollow, once the borehole has been made, it is possible to inject grout or concrete into it so as to constitute the pile progressively as the auger is extracted from the borehole.

For reasons both of structure and of acceptable bulk for a moving machine, the height of the mast 14 and the height H of the auger 22 are always restricted to a value of no more than about 20 meters (m). Unfortunately, on some sites, it is desirable to be able to bore boreholes and to cast piles to a depth of about 25 m.

In order to enable such piles to be made, proposals have already been put forward to add an extender tube 28 to the top portion of the auger 22, which tube has subsequently become known as a "Kelly". A Kelly 28 of length h is secured to move in rotation and translation with the top end of the auger, and the top end 28*b* of the Kelly 28 is connected via a rotary joint 30 to a concrete feed pipe 32. It will be understood that this makes it possible to bore a pile to a depth equal to H+h, which amounts to about 25 m. It should be understood that the rotary drive head 20 can co-operate equally well with the core 24 of the auger and with the Kelly 28.

A major drawback of such a system lies in the way in which the concrete is introduced into the borehole in order to make the pile. The concrete flows out directly from the open bottom end 24*a* of the hollow core of the auger. Moving this bottom end 24*a* by means of the carriage 18 is difficult and there is a risk of the bottom end being pulled out above the fill of concrete while the tool is being withdrawn. Such a discontinuity is accompanied by a risk of the terrain in which the borehole has been drilled caving in locally and severely harming the mechanical strength of the pile made in this way.

French patent No. 2 566 813 in the name of Soletanche discloses an auger type boring machine which makes it possible to avoid the above-mentioned drawback. That hollow-core auger is fitted with a tube that is slidably mounted in the hollow core of the auger, said tube usually being referred to as a "dip" tube. This tube is in a retracted position inside the auger while the borehole is being bored and its bottom end is moved so as to project from the bottom end of the auger while the auger is being raised so as to enable concrete to be injected into the borehole. That technique makes it possible to ensure that the pile made is of good quality and in particular to ensure that concrete injection is continuous over the full height of the borehole.

It will be understood that there exists a real need for an auger type boring machine for making cast piles which makes it possible both to make piles to greater depth and to obtain piles of good quality, and in particular piles that have good continuity in their concrete structure.

OBJECTS AND SUMMARY OF THE INVENTION

An object of the present invention is to provide such a boring machine that satisfies those two requirements simultaneously.

According to the invention, this object is achieved by a machine for making bored piles, the machine comprising:

vertical guide means;

a rotary drive head that is movable relative to said vertical guide means;

an auger having a hollow core and at least one helical blade, said core having open top and bottom ends;

an extender tube whose bottom end is secured to the top end of the core of the auger, said rotary drive head co-operating with said extender tube to rotate the assembly constituted by the auger and the extender tube;

a dip tube slidably mounted in the hollow core of the auger and in the extender tube, the dip tube having a top end connected to a concrete feed pipe;

actuator-forming means having a first end constrained in translation relative to the top end of said extender tube and a second end constrained in translation relative to the top end of said dip tube; and means for controlling the actuator-forming means to modify the position of the bottom end of said dip tube relative to the position of the bottom end of the core of said auger.

It will be understood that because the hollow core of the auger is extended by an extender tube or Kelly, it is possible to make piles down to a depth which is extended substantially by the length of the Kelly. It can also be seen that installing a moving dip tube in the assembly constituted by the hollow core of the auger and the Kelly it is possible to benefit from all of the advantages of a dip tube concerning control over injecting concrete or grout into the borehole so as to obtain a pile.

Preferably, said actuator forming means comprise an annular body surrounding the dip tube and constrained in translation relative to the top end of the extender tube, and an annular moving portion surrounding the dip tube and constrained in translation relative to the top end of the dip tube.

It will be understood that because of the presence of the annular actuator, it is possible to control the position of the bottom end of the dip tube accurately relative to the bottom end of the hollow core of the auger, thus making it possible to obtain high quality injection of concrete into the borehole as the auger and the Kelly are raised progressively, and in spite of the presence of the Kelly. In addition, using an annular actuator surrounding the dip tube makes it possible to avoid creating any axial offset between the dip tube and the assembly comprised by the Kelly and the auger.

BRIEF DESCRIPTION OF THE DRAWINGS

Other characteristics and advantages of the invention will appear more clearly on reading the following description of various embodiments of the invention given as non-limiting examples. The description refers to the accompanying figures, in which.

MORE DETAILED DESCRIPTION

Figure 1:
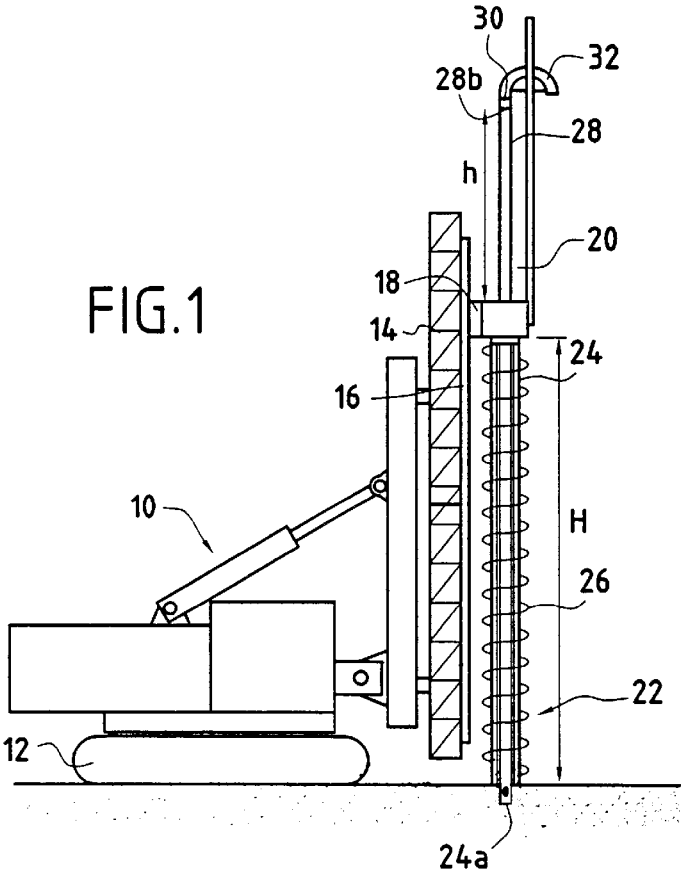
FIG. 1, described above, shows a known machine for making bored piles of increased depth.
Figure 2:
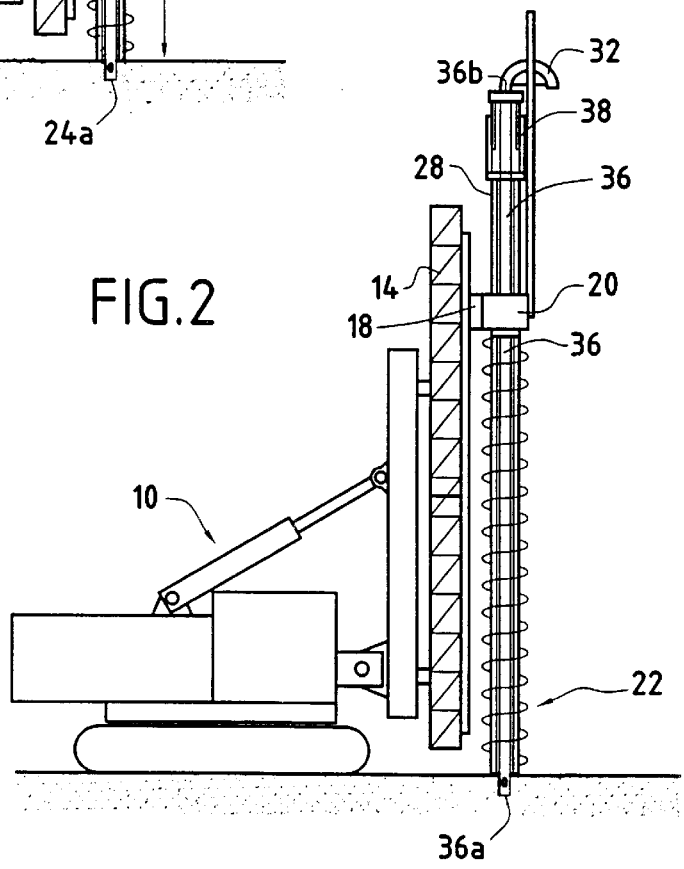
FIG. 2 is an overall elevation view of the boring machine of the invention.
Figure 3A:
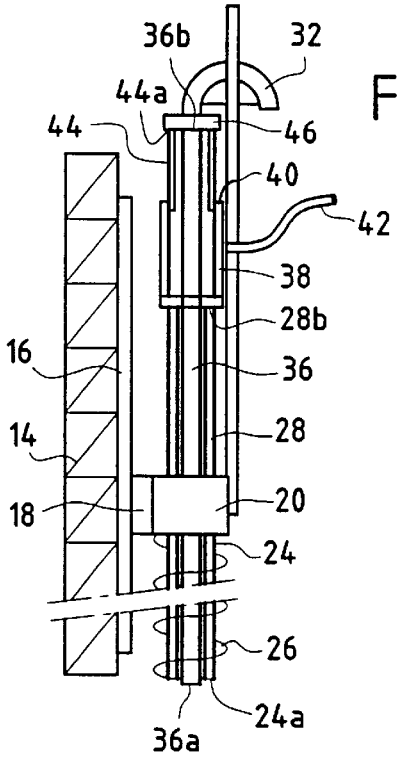
FIG. 3A is a fragmentary view of FIG. 2 showing the dip tube in the retracted position.
Figure 3B:
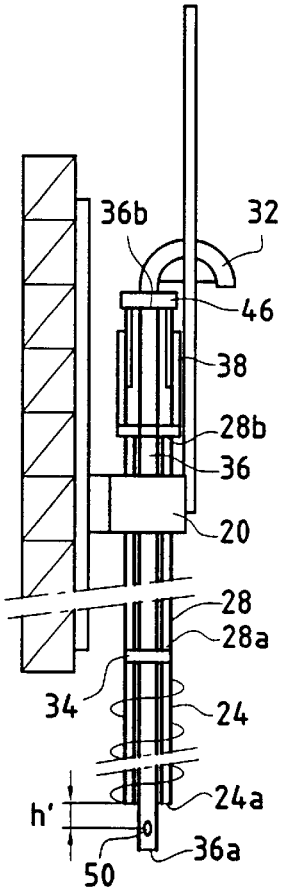
FIG. 3B is a view analogous to FIG. 3A showing the dip tube in the extended position.

A preferred embodiment of the boring machine is described, initially with reference to FIGS. 2, 3A, and 3B.

In FIG. 2, there can be seen the platform 10 with its vertical guide mast 14 having a rotary drive head 20 and a hollow auger 22 whose hollow core 24 is connected in translation and in rotation to the bottom end 28*a* of the Kelly 28. The mechanical connection between the core of the auger and the Kelly is of any suitable kind that enables the rotation and the translation of the rotary drive head 20 to be transmitted from the Kelly 28 to the core 24 of the auger 22. In FIG. 3B, these mechanical connection means are referenced 34.

In accordance with the invention, the machine also has a dip tube 36 which is slidably mounted in the hollow core 24 of the auger and in the Kelly 28. The dip tube 36 has a bottom end 36*a* and a top end 36*b* which is connected to the pipe 32 for feeding concrete or grout to the dip tube 36. As can be seen more clearly in FIG. 3A, the top end 28*b* of the Kelly is connected to an annular actuator 38 which is interposed between the top end 28*b* of the Kelly and the top end 36*b* of the dip tube. This annular actuator 38 which surrounds the top portion of the dip tube is constituted by an annular body 40 which surrounds the dip tube 36 and which is constrained in translation to move with the top end 28*b* of the Kelly but which is preferably free to rotate relative thereto. The body 40 of the annular actuator 38 is connected to a pipe 42 for feeding fluid under pressure to control the actuator 38. The actuator also has an annular moving portion 44 which surrounds the dip tube 36 and which has a top end 44*a* that is connected to the top end 36*b* of the dip tube via connection means 46 which constrain the moving portion of the actuator to move in translation together with the dip tube, while nevertheless preferably leaving them free to move in rotation. Also preferably, the connection system 46 also constitutes a rotary joint for the pipe 32 feeding the dip tube 36 with concrete.

It will be understood that because of the presence of the annular actuator 40, it is possible in any position of the assembly constituted by the auger 22 and the Kelly 28 to define a retracted position for the dip tube 36 (FIG. 3A) in which the end 36*a* of the dip tube is retracted relative to the bottom end 24*a* of the core of the auger, and also an extended position as shown in FIG. 3B. In the first case, the body of the annular actuator 40 is fed with fluid under pressure, thereby raising the dip tube relative to the assembly constituted by the auger and the Kelly. In contrast, when feed to the body 40 of the actuator is interrupted, the dip tube is lowered relative to the assembly constituted by auger and the Kelly, and its bottom end 36*a* projects beyond the bottom end 24*a* of the core of the auger. In this position, it is possible to use the dip tube to control injection of concrete into the borehole previously bored by the auger 22. For this purpose, and in conventional manner, the side wall of the dip tube is provided with injection orifices such as 50 which are preferably close to its bottom end 36*a*. In the injection position, the orifices 50 are at a controlled depth h' below the bottom end 24*a* of the auger, thus making it possible to keep the injection orifices 50 beneath the free surface of the concrete which is progressively filling the borehole.

Likewise in conventional manner, it is possible to fit the bottom end 36*a* with a boring tool which facilitates the action of the auger while boring the hole. Under such circumstances, it can be advantageous to provide for the dip tube 36 to be constrained to rotate with the auger 22 and the Kelly 28. This is made possible by having a rotary joint 46 providing the connection between the feed pipe 32 and the dip tube 36.

Figure 4:
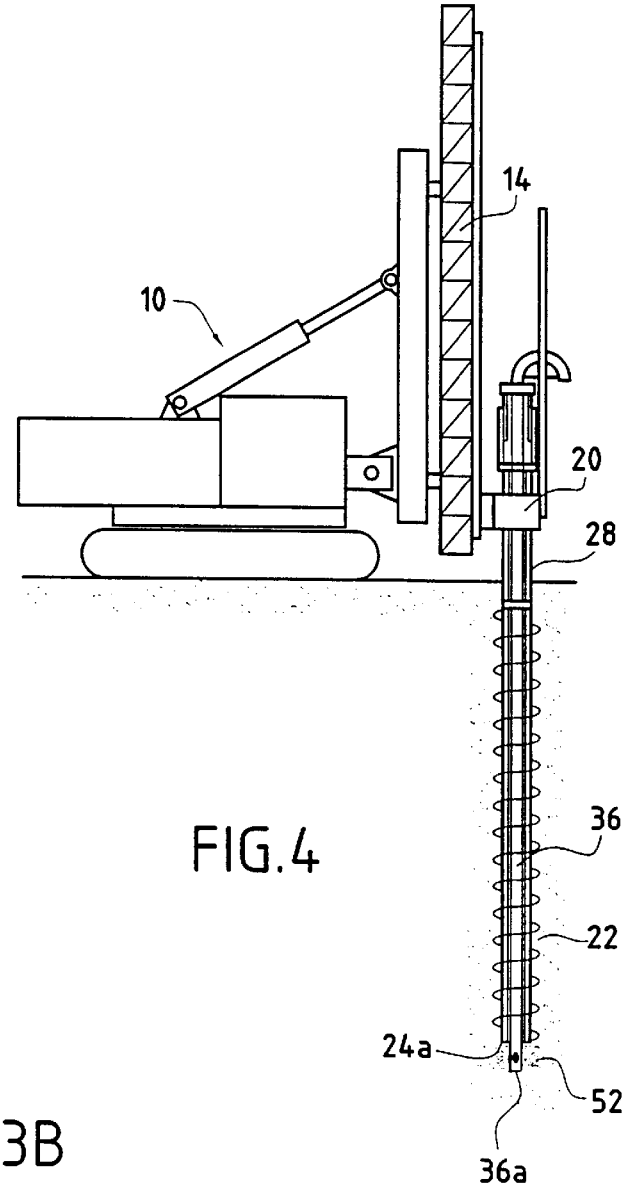
FIG. 4 is an overall view of the machine after the borehole has been made.

FIG. 4 shows the flow filling the borehole after it has been bored. The bottom end 36*a* of the dip tube is disposed beneath the bottom end of the auger 24*a* in such a manner that the orifices 50 enable concrete to be injected beneath the auger into the bottom portion 52 of the borehole. Then, with the annular actuator 38 holding the dip tube 36 in the extended position, the assembly constituted by the auger 22, the Kelly 28, and the dip tube 36 is raised as a whole via the rotary drive head 20. The length h' between the end 24*a* of the hollow auger and the injection orifices 50 provides a safety margin for ensuring that the orifices 50 do indeed remain properly located beneath the free surface level of the concrete while the auger and the dip tube are being raised.

It will be understood that the above-defined machine makes it possible firstly to make bored piles to increased depth because of the presence of the Kelly 28 mounted on the top end of the core of the auger, and secondly to obtain cast piles of high quality because of the presence of the dip tube 36 and the possibility of moving it relative to the auger 22 because of the presence of the annular actuator 38 which can be controlled independently of the position of the rotary drive head 20 and thus of the position of the auger.

What is claimed is:

1. A machine for making bored piles, the machine comprising:

vertical guide means;

a rotary drive head that is movable relative to said vertical guide means;

an auger having a hollow core and at least one helical blade, said core having open top and bottom ends;

an extender tube whose bottom end is secured to the top end of the core of the auger, said auger and said extender tube forming an assembly, said rotary drive head co-operating with said extender tube to rotate the assembly constituted by the auger and the extender tube;

a dip tube slidably mounted in the hollow core of the auger and in the extender tube, the dip tube having a top end connected to a concrete feed pipe and a bottom end provided with at least one outlet;

actuator means having a first end constrained in translation relative to the top end of said extender tube and a second end constrained in translation relative to the top end of said dip tube; and means for controlling said actuator means to modify the position of the bottom end of said dip tube relative to the position of the bottom end of the core of said auger, between a first position wherein the bottom end of the dip tube is within said core auger and a second position wherein said at least one outlet of said dip tube are out of said core auger.

2. A machine according to claim 1, wherein said actuator means comprise an annular body surrounding the dip tube and constrained in translation relative to the top end of the extender tube, and an annular moving portion surrounding the dip tube and constrained in translation relative to the top end of the dip tube.

3. A machine according to claim 1, wherein said vertical guide means comprise a mast and a carriage movable along said mast, said rotary drive head being secured to said carriage.

4. A machine according to claim 1, wherein said at least one outlet for concrete opens out through its side wall, said outlet being set back from the bottom end of said dip tube.

5. A machine according to claim 1, further comprising a rotary joint, the top end of said dip tube being connected to said concrete feed pipe via said rotary joint.

6. A machine for making bored piles, the machine comprising:

a vertical guide means;

a rotary drive head that is moveable relative to said vertical guide means;

an auger having a hollow core and at least one helical blade, said core having open top and bottom ends;

an extender tube whose bottom end is secured to the top end of the core of the auger, said auger said extender tube forming an assembly, said rotary drive head cooperating with said extender tube to rotate said assembly constituted said auger and said extender tube;

a concrete feed pipe;

a dip tube slidably mounted in the hollow core of the auger and in the extender tube, said dip tube having a top end connected to said concrete feed pipe and a bottom end provided with at least on outlet;

actuator means comprising an annular body surrounding said dip tube, said body having a first end constrained in translation relative to the top end of said extender tube and a second end constrained in translation relative to the top end of said dip tube; and means for controlling said actuator means to modify the position of the bottom end of said dip first relative to the position of the bottom end of the core of said auger, between a first position wherein the bottom end of the dip tube is within said core auger and a second position wherein said at least one outlet of said dip tube out of said core auger.

* * * * *